US007370370B2

(12) United States Patent
Colombo

(10) Patent No.: US 7,370,370 B2
(45) Date of Patent: May 13, 2008

(54) PNEUMATIC DEVICES FOR PERSONAL PROTECTION AND RELEVANT ARTICLE OF CLOTHING INCLUDING SUCH DEVICE

(75) Inventor: Fabio Giovanni Colombo, Milan (IT)

(73) Assignees: Antonio Primo Colombo, Milan (IT); Fabio Giovanni Fedele Colombo, Milan (IT)

( * ) Notice: Subject to any disclaimer, the term of this patent is extended or adjusted under 35 U.S.C. 154(b) by 134 days.

(21) Appl. No.: 10/566,160

(22) PCT Filed: Aug. 5, 2004

(86) PCT No.: PCT/IT2004/000438

§ 371 (c)(1),
(2), (4) Date: Jan. 27, 2006

(87) PCT Pub. No.: WO2005/013737

PCT Pub. Date: Feb. 17, 2005

(65) Prior Publication Data

US 2006/0248632 A1 Nov. 9, 2006

(30) Foreign Application Priority Data

Aug. 6, 2003 (IT) ..... MI20030380 U

(51) Int. Cl.
*A41D 13/00* (2006.01)

(52) U.S. Cl. ..... 2/69; 2/DIG. 3

(58) Field of Classification Search ..... 2/69, 2/102, 94, DIG. 3, 410, 413, 424, 425, 108
See application file for complete search history.

(56) References Cited

U.S. PATENT DOCUMENTS

| | | | | |
|---|---|---|---|---|
| 5,263,203 | A * | 11/1993 | Kraemer et al. | 2/413 |
| 5,937,443 | A | 8/1999 | Kageyama et al. | |
| 6,079,056 | A * | 6/2000 | Fogelberg | 2/461 |
| 6,230,333 | B1 | 5/2001 | Umeda | |
| 6,270,386 | B1 | 8/2001 | Visocekas | |

FOREIGN PATENT DOCUMENTS

| | | |
|---|---|---|
| DE | 196 40 658 A1 | 4/1998 |
| EP | 0 043 990 A1 | 1/1982 |

* cited by examiner

*Primary Examiner*—Tejash Patel
(74) *Attorney, Agent, or Firm*—Wenderoth, Lind & Ponack, L.L.P.

(57) ABSTRACT

A pneumatic device for personal protection has at least one sac-like gas-tight element connectable through an inlet box to automatically release inflating means and attaching means co-operating, in working position, with the body of a user so that the sac-like element is kept in a position which corresponds to a portion of the body to be protected. The sac-like element encloses a variable volume chamber which is intended to be filled with a gas introduced therein via an inlet box. The chamber includes inside flexible partition members extending lengthwise a greater side of the chamber and connected along their edges extending lengthwise to two opposite walls of the chamber. The flexible partition members divide the chamber into a plurality of compartments arranged one next to another and in fluid communication with each other.

6 Claims, 6 Drawing Sheets

PNEUMATIC DEVICES FOR PERSONAL PROTECTION AND RELEVANT ARTICLE OF CLOTHING INCLUDING SUCH DEVICE

CROSS-REFERENCES TO RELATED APPLICATIONS

This application is the national stage of International Application No. PCT/IT2004/000438, filed on Aug. 5, 2004.

BACKGROUND OF THE INVENTION

1. Field of the Invention

The present invention relates to a pneumatic device for personal protection, particularly for motorcycle riders, horse riders and the like, and to an article of clothing including such a device.

The present invention is included in the technical field of personal protecting devices and garments for protecting human beings in the case of an accidental fall off of a two-wheeled vehicle and, more generally, from any motor-driven and motorless vehicle, horses and the like or equipment for leisure/work activities, wherein the body of a human being is exposed to the risk of severe injuries upon an impact against the ground or an obstacle.

Devices of this kind are already known in the art and are made according to various embodiments.

2. Description of Related Art

Document EP 0 043 990 B1 offers an example of an embodiment similar to that of the present invention, although in a limited extent with regard to some common features.

In the document mentioned above, a protecting device for motorcyclists is disclosed which comprises at least a gas-tight chamber and inflating means with automatic releasing.

The gas-tight chamber comprises a spine protecting element, a neck protecting element, as well as an element for protecting the pelvic area of the motorcyclist.

The protecting device further comprises attaching means intended to cooperate, in a working position, with the body of the user so as to maintain the gas-tight chamber in a position corresponding to the respective portion of the body to protect.

The protecting device is removably attached to a garment or removably incorporated in its internal lining.

A drawback which is to be found in a protecting device of the kind described above is depending on the fact that the gas-tight chamber, when inflated, is subject to a change in its geometric shape under the action of the pressure exerted by the gas introduced thereinto.

For instance, considering the case of a gas-tight chamber formed of a tubular element which, in the deflated condition, is substantially flat and exhibits a width L, when the tubular element, upon inflation, takes the shape of substantially circular cylinder, the width of the tubular element becomes equal to $L'=2\times L/\pi$. Therefore, it becomes reduced in relative terms to a quantity equal to $\Delta L/L=(L-L')/L=1-2/\pi$, corresponding to about 36% of the original width L.

As a result of the inflation of the tubular element, it follows that there is a diminishing of the region of the body which is protected and, therefore, a general decreasing in the effectiveness of the protecting device.

It should be noticed, also, that the thickness of the tubular element is not constant, having a minimum at the side portions and a maximum at the central portion. This fact also is detrimental to the effectiveness of the protecting device.

BRIEF SUMMARY OF THE INVENTION

The object of the present invention is, therefore, to improve the effectiveness of protecting devices known in the art of the kind described above by using a device aimed at limiting the drawbacks connected with the unavoidable change in the geometric shape of the gas-tight chamber upon its inflation.

According to the present invention, this object is achieved in that the chamber internally comprises flexible partition members which extend lengthwise a greater side of the chamber and are connected along their edges to opposite walls of the chamber, wherein the flexible partition members divide the chamber into a plurality of compartments arranged one next to another and in fluid communication with each other.

The present invention is based on the idea that, in order to achieve an effective protection of the portions of a motorcyclist's body protected by the protecting device, a change which is too great in the geometric shape of the gas-tight chamber upon its inflation should be avoided. Such a change would expose a portion of the body to protect to the impact against the ground or an obstacle following to a fall off from a motorcycle and would cause the degree of protection to be not uniform.

The solution to this technical problem is given in that the flexible partition members arranged inside the gas-tight chamber contribute to greatly limit the changes in the width of gas-tight chamber in passing from a deflated condition to an inflated condition. The flexible partition members also cause the thickness of the gas-tight chamber in the inflated condition to be the most uniform as possible, so that the protecting features are substantially the same in all points of the region of the body of a motorcycle rider for which protection is sought.

BRIEF DESCRIPTION OF THE DRAWINGS

The present invention will be now described in more detail with reference to the accompanying drawings, wherein.

DETAILED DESCRIPTION OF THE INVENTION

Figure 1:
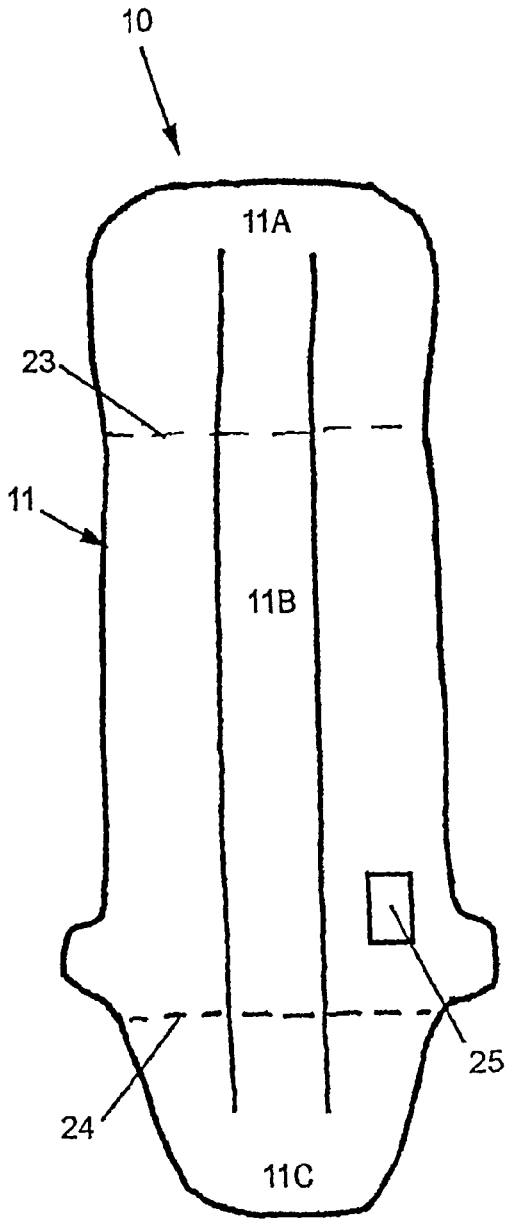
FIG. 1 is a rear elevation view of the pneumatic device for personal protection of the present invention in a deflated condition.
Figure 2:
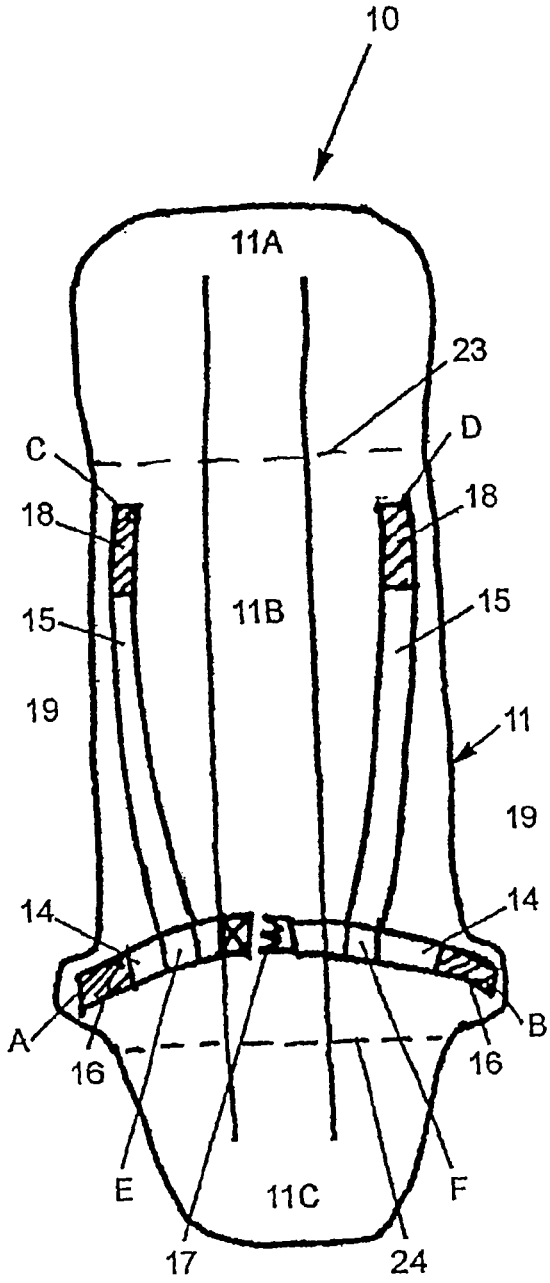
FIG. 2 is a front elevation view of the pneumatic device for personal protection of the present invention in a deflated condition.
Figure 3:
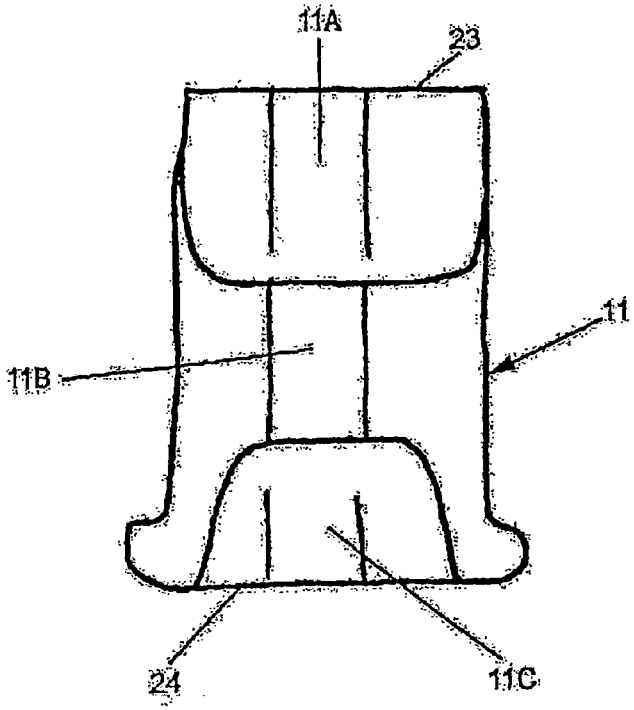
FIG. 3 is a rear elevation view of the pneumatic device for personal protection of the present invention in a deflated condition and with an upper and lower portion folded upon a central portion.
Figure 4:
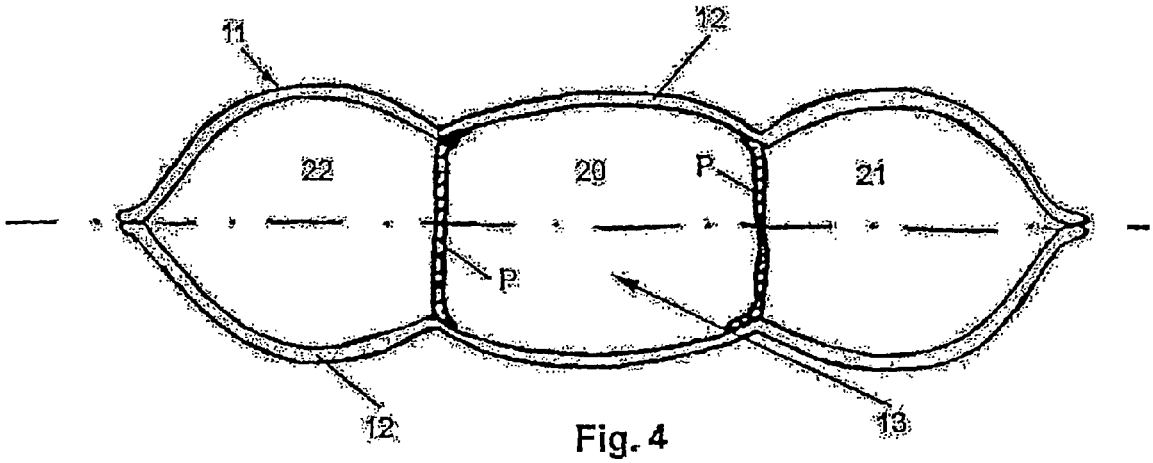
FIG. 4 is a cross-section view of the device for personal protection in a deflated condition.
Figure 5:
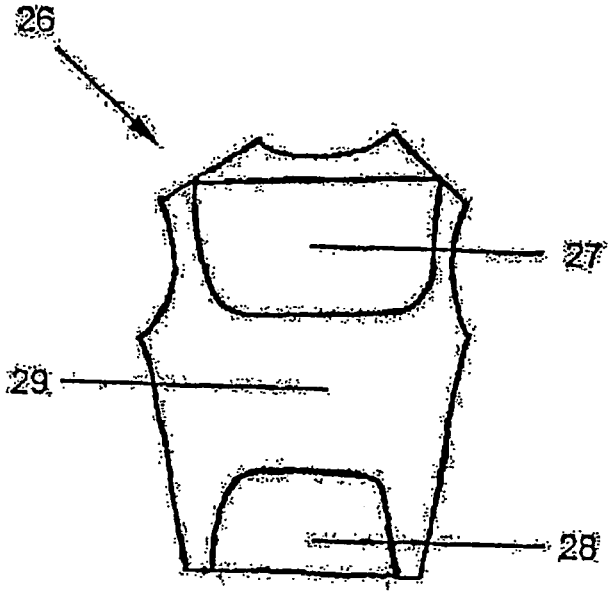
FIGS. 5 and 6 are a rear elevation view of an article of clothing suitable to include the pneumatic device for personal protection of the present invention, shown in two different operative conditions corresponding to the situation wherein the pneumatic device for personal protection is in a deflated and inflated condition, respectively.
Figure 6:
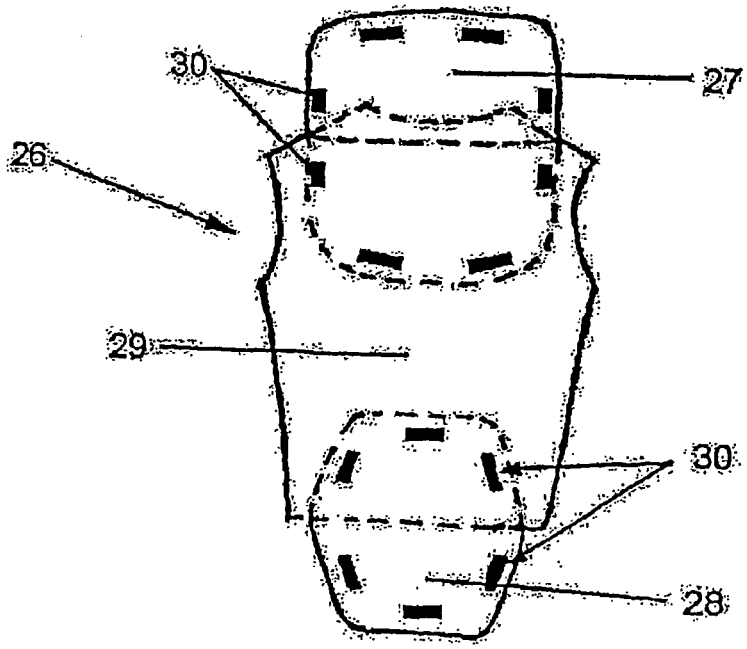

In the following description, Part 1 describes a pneumatic device for personal protection. Part 2 describes an article of clothing including the device. Part 3 describes the mode of use of the article of clothing and the operation of the pneumatic device for personal protection. Part 4 highlights the main features of the pneumatic device for personal protection and the relevant article of clothing containing such a device, in connection with the achievement of the object aimed at of the present invention. At last, Part 5 provides results of tests carried out on a model of the present invention.

1. The Pneumatic Device for Personal Protection

FIGS. 1 to 4 illustrate the pneumatic device for personal protection according to the present invention, generally designated by 10. The device consists of a sac-like gas-tight element 11 formed of a pair of impervious or adequately gas-tight (controlled permeability) sheets 12 sealed to each other at their respective edges. The so joined sheets 12 enclose a variable volume chamber 13 into which a suitable amount of gas is introduced for inflating the sac-like element 11.

The sac-like element 11 is provided on the outside with attaching means formed of a pair of abdominal belts 14 and a pair of shoulder straps 15 permitting the pneumatic device for personal protection to be supported by and to be kept adhered to the back of a user, f.i. a motorcycle rider.

The abdominal belts 14 exhibit resilient elements 16 at one end thereof by which they are connected to the sac-like element 11 at points A and B, respectively, whereas the abdominal belts 14 exhibit coupling elements at an opposite end thereof which are formed, e.g. by a snap-acting buckle 17.

Also, the shoulder straps 15 have resilient elements 18 in one end thereof by which they are connected to the sac-like element 11 at points C and D, respectively, whereas the shoulder straps 15 are connected at an opposite end to the abdominal belts 14 at points E and F.

Suitably, both the abdominal belts 14 and the shoulder straps 15 are adjustable in a manner known in the art by means of loops 19 in order to be capable of fitting to the size of the user.

As mentioned above, the sac-like element 11 includes therein a variable volume chamber 13. This chamber is partitioned into a plurality of compartments, preferably three, indicated with numerals 20, 21 and 22. These compartments are in fluid communication one with the other and extend inside the chamber 13 lengthwise. The compartments are separated by flexible internal partitions P formed by strips which are connected to sheets 12 of the sac-like element and extend inside the chamber 13 lengthwise.

Finally, the sac-like element 11 exhibits two transverse folding lines 23 and 24 which define three portions of the sac-like element, viz. an upper portion, a central portion and a lower portion, indicated with 11A, 11B and 11C, respectively. By means of these folding lines 23 and 24 the upper end lower portions 11A, 11C of the sac-like element can be folded upon the central portion 11B to permit a suitable wearability of the article of clothing inside which the sac-like element is intended to be contained.

The sac-like element 11 is intended to be inflated by means of an amount of gas which is introduced therein through an inlet box 25 to which a suitable gas supply not shown is connected. An example of gas supply that can be used is a device known in the art, of the kind exhibiting a rapid activation.

2. The Article of Clothing Containing the Pneumatic Device for Personal Protection FIGS. 5 to 8 of the drawings illustrate the article of clothing containing the pneumatic device for personal protection according to the present invention.

The article of clothing, generally designated by 26, is preferably formed of a garment of the kind with or without sleeves. For exemplification purpose only and not intended to be limited thereto, there is shown a garment without sleeves, so called "waistcoat". The garment exhibits two pivotable attachments or flaps 27 and 28 which are joined to the upper and lower portion, respectively, of the waistcoat and intended to be releasably fastened to a back side 29 of the waistcoat in normal use condition by means of releasable touch-and-close fastening elements 30, e.g. of the kind so called "hook and loop" available in the trade with the trading name Velcro®. Further, the waistcoat 26 has a front portion 31 which is closable by means of a zipper or like.

As mentioned above, the garment 26 is intended to contain therein the sac-like element 11 of the pneumatic device for personal protection and to this purpose it has an internal lining and a opening in the lower portion to permit the sac-like element 11 to be inserted therein.

The attachments or flaps 27, 28 of the garment are each in the form of a pocket. The upper pocket 27 serves as container for the upper portion 11A of the sac-like element, whereas the lower pocket 28 serves as container for the lower portion 11C of the sac-like element. To this purpose the upper 27 and lower 28 pockets can be opened towards the inside of the garment for receiving corresponding portions 11A and 11C of the sac-like element 11.

In normal use, the pockets 27 and 28, containing therein the relevant portions 11A and 11C of the sac-like element, are folded upon the back portion 29 of the garment and releasably fastened thereto by means of the fastening elements 30.

Figure 7:
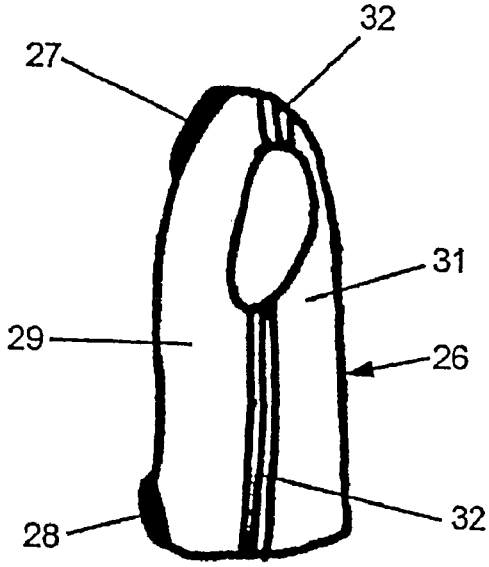
FIGS. 7 and 8 are a side elevation view respectively of an article of clothing including the pneumatic device for personal protection of the present invention in a deflated condition and a motorcycle rider wearing the same article of clothing.
Figure 8:
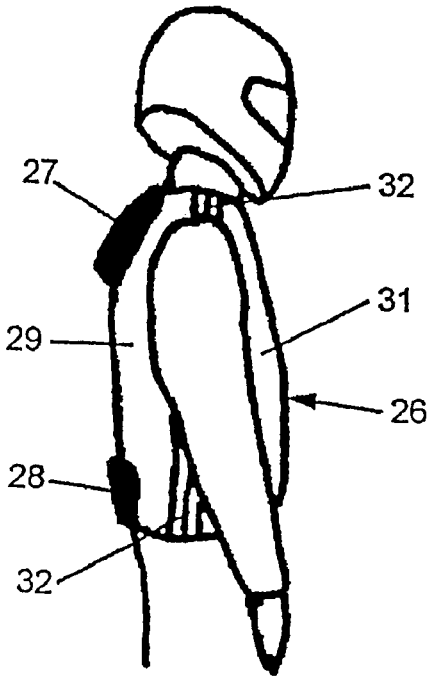

To permit expansion of the inflatable sac-like element, the garment 26 is provided with resilient inserts 32 placed between the back portion 29 and the front portion 31 of the garment 26 and located on the shoulders and sides, as can be seen in particular in FIGS. 7 and 8.

The garment 26 is provided furthermore with eyelets made in the lining of the back portion 29 to permit the abdominal belts 14 and shoulder straps 15 of the pneumatic device for personal protection to pass therethrough for the purpose of making these parts operable by the user.

3. Mode of Use of the Article of Clothing and Operation of the Device for Personal Protection The mode of use of the article of clothing, together with the operation of the device for personal protection contained therein, will be described now with reference to FIGS. 7 to 12 of the drawings.

The article of clothing 26 is worn by the user, in the example shown a motorcycle rider, as a garment of conventional kind.

The pneumatic device for personal protection contained inside the article of clothing is kept attached to the back of user, by suitably adjusting the abdominal belts 14 and the shoulder straps 15 and by closing the snap-acting buckle 17, so as to cover the spinal column. In so doing, the sac-like element 11 is always positioned correctly upon the spinal column, even when it is in the inflated condition, and the possibility that it becomes displaced from its original correct position, thereby uncovering the region of the spinal column to be protected, is prevented.

The sac-like element 11 is inflated by means of a determined amount of gas introduced therein through a suitable gas supply connected to the inlet box 25.

The flow of gas introduced in the sac-like element 11 is suitably conveyed by one of the internal partitions P located near to the area where the gas is introduced, along a preferred path inside the chamber 13. In particular, the lengthwise arrangement of the partitions P is such that the flow of gas is conveyed at first inside one of the compartments 20, 21, 22 of the chamber 13 towards the upper portion 11A and the lower portion 11C of the sac-like element, in order to inflate these portions in the first moments following the activation of the inflating device.

Figure 9:
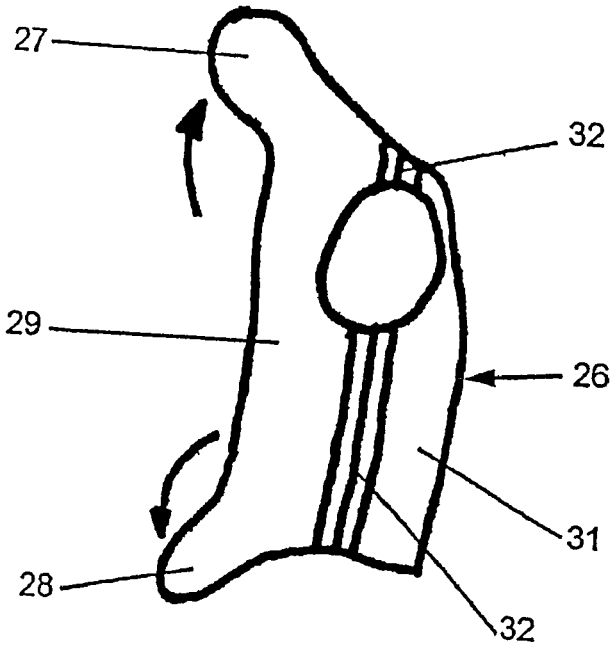
FIGS. 9 and 10 are a side elevation view respectively of an article of clothing including the pneumatic device for personal protection of the present invention during inflation and a motorcycle rider wearing the same article of clothing.
Figure 10:
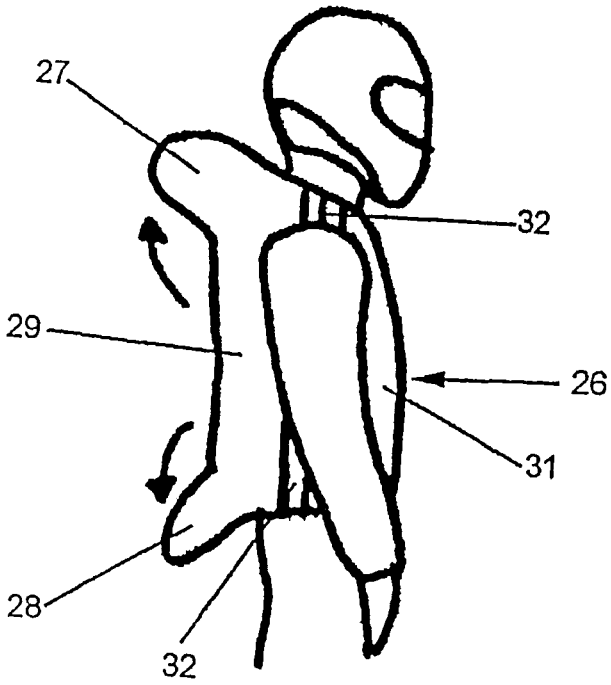

Inflation of portions 11A and 11C of the sac-like element thus causes the releasing of the fastening elements 30 which fasten pockets 27 and 28 to the back 29 of the article of clothing. Therefore, in the first moments following the activation of the inflating device, portions 11A and 11C of the sac-like element 11 become inflated and the pockets 27, 28 containing these portions of the sac-like element 11 unfasten from back 29 and unfold towards the top and the bottom, as shown in FIGS. 9 and 10 of the drawings.

Figure 11:
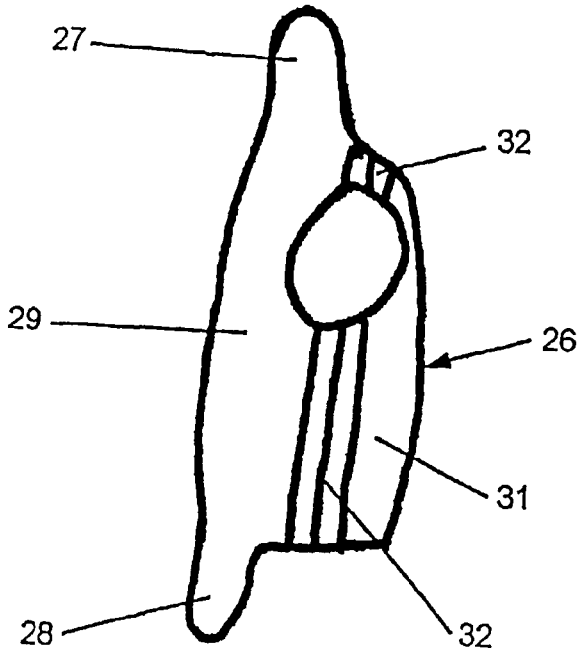
FIGS. 11 and 12 are a side elevation view respectively of an article of clothing including the pneumatic device for personal protection of the present invention in an inflated condition and a motorcycle rider wearing the same article of clothing.
Figure 12:
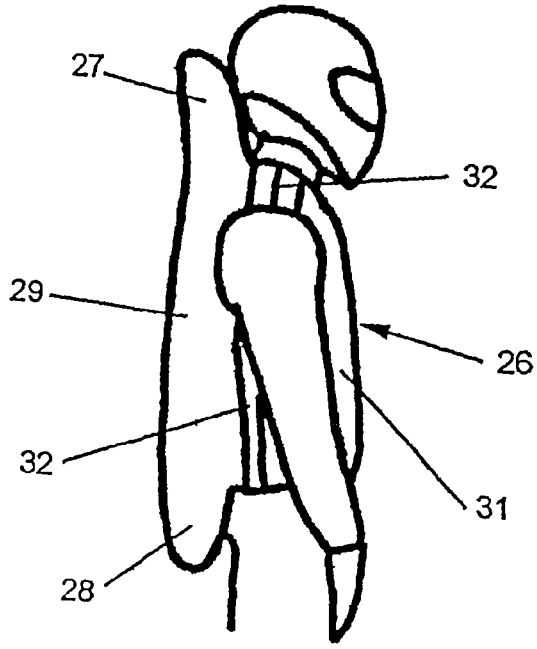

Afterwards, the gas diffuses inside all compartments 20, 21, 22 into which chamber 13 is partitioned to completely inflate also the portion 11B of the sac-like element, as shown in FIGS. 11, 12 of the drawings.

4. Features of the Pneumatic Device for Personal Protection and the Article of Clothing It is important to highlight herein some important features of the pneumatic device according to the present invention and the article of clothing containing it, features which result from the configuration of the same disclosed in Part 1 of the description.

Referring to the pneumatic device for personal protection, a first feature results from the existence and particular arrangement of the partitions P inside the chamber 13 of the sac-like element 11. When the sac-like element 11 is in the inflated condition, the three compartments 20, 21, 22 inside the chamber 13 in the example illustrated form three pneumatic elements of tubular shape protecting the spinal column of the motorcycle rider. The protection offered by these tubular pneumatic elements is substantially uniform because the existence and arrangement of the internal partitions P defining the compartments 20, 21, 22 inside the chamber 13 provide a substantially regular thickness of the sac-like element in the inflated condition. This permits the sac-like element to absorb and dissipate the energy involved in an impact in a substantially uniform way, not depending from the direction of the impact with respect to the sac-like element and to its location on the sac-like element itself. In fact, the regularity in thickness of the sac-like element provides a uniform collision absorbing feature, i.e. each area of the sac-like element exhibits substantially the same conditions for reducing the kinetic energy of a collision. Of course, the degree of reduction of the amount of force transmitted to the spinal column is dependent on the design of partitions P inside the chamber 13 and the chosen value of the operating pressure.

A second feature of the device for personal protection, which also results from the existence and arrangement of the partitions P inside the chamber 13 of the sac-like element 11, consists in that the change in the width of the sac-like element 11 following its inflation is reduced to a minimum. This prevents advantageously an excessive reduction of the region of the spinal column protected by the sac-like element and therefore, generally, a reduction of the effectiveness of the pneumatic protective device. This feature is particularly important in that the sac-like element in the deflated condition is positioned upon the region of the spinal column of the motorcycle rider and it is necessary that its width in the deflated condition is not greater than the width of the back for the purpose of avoiding the sac-like element to be folded also on the sides in order to introduce it into the article of clothing. In the present invention, since the change in width of the sac-like element is reduced, folding the sac-like element on the sides is not necessary, whereas it suffices to fold it only at the upper and lower portions. Therefore, since the number of foldings is reduced, the time required for inflation of the sac-like element is very short compared to other pneumatic devices for personal protection known in the art, as will be apparent in the following from the result of the tests described in Part 5 of the description. Furthermore, because of the reduced number of foldings required, a greater wearability is achieved of the article of clothing containing the sac-like element.

A third feature of the pneumatic device for personal protection, resulting again from the existence and arrangement of the partitions P inside the chamber 13 of the sac-like element 11, is that these partitions P have the task to convey the gas introduced inside the chamber 13 along defined paths towards the upper portion 11A and the lower portion 11C, respectively of the sac-like element 11, thus avoiding that the pressure energy of the gas is disorderly dissipated inside the sac-like element 11. The flow gas is, instead, guided towards portions 11A and 11C in order to cause immediately the inflation thereof and thus their unfolding to protect the cervix and sacrum regions of the motorcyclist.

Referring instead to the article of clothing, a fourth feature is that the arrangement of the fastening elements 30 which fasten pockets 27,28 to back 29 of the article of clothing is chosen depending on the location of the point where the gas is introduced inside the sac-like element 11 in order to achieve simultaneous unfolding of portions 11A and 11B of the sac-like element which are contained in pockets 27 and 28, respectively, and folded upon the back 29. In the example shown in FIG. 1 of the drawings, it can be clearly seen that the point where the gas is introduced is located at the bottom, near the lower portion 11C of the sac-like element, whereby this portion 11C would inflate and, therefore, unfold before the upper portion 11A. In this situation, it is necessary to devise a means to hold the lower portion 11C of the sac-like element in a greater degree than the upper portion 11A, so that the moment in which the lower portion starts to unfold is slightly lagging and is made synchronous with the moment in which the upper portion 11A of the sac-like element starts to unfold. The means devised in the present invention consists in increasing the extension or the number of the fastening elements 30 which hold pocket 28 fastened to back 29 so that the fastening force acting thereby is slightly greater than the force fastening pocket 27 to same back 29.

A fifth feature relating again to the article of clothing is that the existence of resilient inserts 32 between the back 29 and the front 31 of the article of clothing 26 on the shoulders and the sides. These resilient inserts serve to permit expansion of the sac-like element without constriction to the user. In fact, when the sac-like element 11 is inflated, the resilient inserts 32 expand to adapt to the increasing volume of the sac-like element 11. Thus, the article of clothing 26 with the sac-like element 11 in the inflated condition does not hinder the user leaving him freedom of movement, i.e., for reacting in situations of danger.

5. Tests on a Model of the Device for Personal Protection and the Article of Clothing The following tests were carried out on a model of the pneumatic device for personal protection according to the present invention.

Inflation Test

A gas supply having a very rapid activation was used with a sac-like element 11 as described above. The inflation was shot with a high speed camera having a shooting rate of 1000 frames per second. The results obtained have shown that the sac-like element inflates in 45-50 ms.

The frames have shown that the existence of the partitions P inside the chamber 13 of the sac-like element 11 improves inflation of the sac-like element 11 and reduces the change in width of the sac-like element following its inflation.

In particular, in the case of the example showing a sac-like element 11 which is provided with two partitions P inside the chamber 13 and has in the deflated condition a width L equal to 300 mm, it was found that the sac-like element 11 upon inflation exhibits a width L' equal to 231 mm, instead of $300\times2/\pi=191$ mm. The relative reduction $\Delta L/L=(L-L')/L$ in the width of the sac-like element 11 resulted in a percent value equal to only 23%, against a theoretical 36% without the partitions P inside the chamber 13 of the sac-like element 11. The percentage of reduction in the width decreases even more with the increasing of the number of partitions P.

Also the thickness of the sac-like element 11 in the inflated condition results to be more uniform because of the existence of partitions P inside the chamber 13 of the sac-like element 11.

It follows that with the existence of partitions P inside the chamber 13, the sac-like element 11 is subjected to a lower reduction in the width caused by the inflation and its thickness is more regular. This assures a more extended and uniform protection of the spinal column of the user.

The same inflation test was repeated putting the sac-like element 11 inside an article of clothing 26 as that described above. The measured inflation time was comprised between 75 and 85 ms. This time delay with respect to the inflation of the sac-like element alone is irrelevant to the operation of the pneumatic device for personal protection and is caused by the fastening elements 30 of the pockets 27,28 on the back 29 of the article of clothing 26. The time delay can be reduced possibly by modifying in a suitable manner the number and position of the fastening elements 30.

Impact Test

The sac-like element 11 in the inflated condition was tested under the specification contained in standard EN 1621-2/2033 "Motorcyclists' protective clothing against mechanical impact—Part 2: Motocyclists' back protectors" and it was found that the force transmitted is equal to only 0.9 kN. This value is very small compared to level 1 (18 kN) and level 2 (9 kN) contained in the above mentioned standard and the result achieved with the model of the present invention highlights its protective ability.

From the foregoing it can be understood that the present invention achieves the aimed object and solves the technical problems inherent in the known art.

It should also be noticed that although the pneumatic device for personal protection and the relevant article of clothing have been disclosed with reference to the use by a motorcycle rider, it is apparent that the present invention is applicable to other users which expose their body to the risk of collisions against obstacles and the ground when carrying out specific activities.

The invention claimed is:

1. A pneumatic device for personal protection comprising a gas-tight element including a sac that is connectable through an inlet box to an automatically releasing inflating means, and said pneumatic device further comprises attaching means co-operating, in working position, with a body of a user so that said element is kept in a position which corresponds to a portion of the body to be protected, wherein said element encloses a variable volume chamber to be filled with a gas introduced therein via said inlet box, wherein said chamber comprises inside flexible partition members extending lengthwise along a longitudinal axis of said chamber, the partition members being connected along edges thereof extending lengthwise to two opposite walls of said chamber, whereby said flexible partition members divide said chamber into a plurality of compartments arranged one next to another such that said compartments are in fluid communication with each other, wherein said pneumatic device is removably attached to a protective article of clothing or removably incorporated in an internal lining of said protective article of clothing, said protective article of clothing including two pivotable attachments or flaps connected to an upper and lower portion thereof, respectively, a back portion and a front portion, said attachments or flaps being releasably fastened to the back of said protective article of clothing and each having the form of a pocket for containing one of a plurality of portions of said element.

2. The pneumatic device for personal protection according to claim 1, wherein the attachments or flaps are attached to the back of said protective article of clothing by releasable touch-and-close fastening means.

3. The pneumatic device for personal protection according to claim 2, wherein the touch-and-close fastening means are designed so that during inflation of said element a simultaneous unfolding of the attachments or flaps is permitted.

4. The pneumatic device for personal protection according to claim 1, wherein said protective article of clothing includes resilient inserts arranged between the back portion and the front portion, and on shoulders and sides of said protective article of clothing, said resilient inserts permitting said element to expand during inflation without causing constriction to the user and giving the user freedom of movement.

5. A pneumatic device for personal protection comprising a gas-tight element including a sac that is connectable through an inlet box to an automatically releasing inflating means, and said pneumatic device further comprises attaching means co-operating, in working position, with a body of a user so that said element is kept in a position which corresponds to a portion of the body to be protected, wherein said element encloses a variable volume chamber to be filled with a gas introduced therein via said inlet box, wherein said chamber comprises inside flexible partition members extending lengthwise along a longitudinal axis of said chamber, the partition members being connected along edges thereof extending lengthwise to two opposite walls of said chamber, whereby said flexible partition members divide said chamber into a plurality of compartments arranged one next to another such that said compartments are in fluid communication with each other, wherein said element comprises an upper portion, a central portion and a lower portion for protecting a cervix portion, a dorsum portion and a sacrum portion, respectively, of a spinal column of the body of the user, the upper and lower portions of said element are arranged to be folded upon the central portion when said element is in a deflated condition, wherein said pneumatic device is removably attached to a protective article of clothing or removably incorporated in an internal lining of said protective article of clothing, said protective article of clothing including two pivotable attachments or flaps connected to an upper and lower portion thereof, respectively, a back portion and a front portion, said attachments or flaps being releasably fastened to the back of said protective article of clothing and each having the form of a pocket for containing one of a plurality of portions of said element.

6. A pneumatic device for personal protection comprising a gas-tight element including a sac that is connectable through an inlet box to an automatically releasing inflating means, and said pneumatic device further comprises attaching means co-operating, in working position, with a body of a user so that said element is kept in a position which corresponds to a portion of the body to be protected, wherein said element encloses a variable volume chamber to be filled with a gas introduced therein via said inlet box, wherein said chamber comprises inside flexible partition members extending lengthwise along a longitudinal axis of said chamber, the partition members being connected along edges thereof extending lengthwise to two opposite walls of said chamber, whereby said flexible partition members divide said chamber into a plurality of compartments arranged one next to another such that said compartments are in fluid communication with each other, wherein said element comprises a pair of impervious sheets sealed together at respective edges thereof, said impervious sheets being joined together and enclosing the variable volume chamber into which an amount of gas is introduced to inflate said element, wherein said pneumatic device is removably attached to a protective article of clothing or removably incorporated in an internal lining of said protective article of clothing, said protective article of clothing including two pivotable attachments or flaps connected to an upper and lower portion thereof, respectively, a back portion and a front portion, said attachments or flaps being releasably fastened to the back of said protective article of clothing and each having the form of a pocket for containing one of a plurality of portions of said element.

* * * * *